US008337045B2

(12) United States Patent
Negley

(10) Patent No.: US 8,337,045 B2
(45) Date of Patent: Dec. 25, 2012

(54) LIGHTING DEVICE AND LIGHTING METHOD

(75) Inventor: Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 11/949,182

(22) Filed: Dec. 3, 2007

(65) Prior Publication Data

US 2008/0130281 A1 Jun. 5, 2008

Related U.S. Application Data

(60) Provisional application No. 60/868,443, filed on Dec. 4, 2006.

(51) Int. Cl.
*F21V 5/00* (2006.01)

(52) U.S. Cl. ..... 362/246

(58) Field of Classification Search ..... 362/246
See application file for complete search history.

(56) References Cited

U.S. PATENT DOCUMENTS

| | | | |
|---|---|---|---|
| 4,346,275 | A | 8/1982 | Iwakiri et al. |
| 4,476,620 | A | 10/1984 | Ohki et al. |
| 4,675,575 | A | 6/1987 | Smith et al. |
| 4,865,685 | A | 9/1989 | Palmour |
| 4,902,356 | A | 2/1990 | Noguchi et al. |
| 4,912,532 | A | 3/1990 | Cook et al. |
| 4,946,547 | A | 8/1990 | Palmour et al. |
| 4,981,551 | A | 1/1991 | Palmour |
| 5,087,949 | A | 2/1992 | Haitz |
| 5,103,271 | A | 4/1992 | Izumiya et al. |
| 5,200,022 | A | 4/1993 | Kong et al. |
| 5,376,241 | A | 12/1994 | Shor et al. |
| 5,376,580 | A | 12/1994 | Kish et al. |
| RE34,861 | E | 2/1995 | Davis et al. |
| 5,477,436 | A | 12/1995 | Bertling et al. |
| 5,502,316 | A | 3/1996 | Kish et al. |
| 5,644,156 | A | 7/1997 | Suzuki et al. |
| 5,939,732 | A | 8/1999 | Kurtz et al. |
| 5,959,316 | A | 9/1999 | Lowery |
| 5,985,687 | A | 11/1999 | Bowers et al. |

(Continued)

FOREIGN PATENT DOCUMENTS

| | | |
|---|---|---|
| EP | 0 684 648 | 11/1995 |

(Continued)

OTHER PUBLICATIONS

U.S. Appl. No. 11/613,692, filed Dec. 20, 2006.

(Continued)

*Primary Examiner* — Evan Dzierzynski
(74) *Attorney, Agent, or Firm* — Burr & Brown

(57) ABSTRACT

A lighting device which comprises at least a first solid state lighting device; and at least a first patterned diffuser which comprises a plurality of optical features. If the first solid state lighting device is illuminated, at least some of the light emitted by the first solid state lighting device enters the first patterned diffuser and exits the patterned diffuser. In some embodiments, the patterned diffuser emits light in a specific shape (e.g., substantially square, rectangular, hexagonal or octagonal). In some embodiments, optical features are positioned on the first surface of the side of the first patterned diffuser that the emitted light enters. Also, a method of lighting which comprises illuminating one (or more) solid state lighting device which emits light which enters a patterned diffuser which comprises a plurality of optical features, and exits the patterned diffuser.

17 Claims, 1 Drawing Sheet

U.S. PATENT DOCUMENTS

| | | | | |
|---|---|---|---|---|
| 6,071,795 | A | 6/2000 | Cheung et al. | |
| 6,225,647 | B1 | 5/2001 | Kurtz et al. | |
| 6,258,699 | B1 | 7/2001 | Chang et al. | |
| 6,274,924 | B1 | 8/2001 | Carey et al. | |
| 6,303,405 | B1 | 10/2001 | Yoshida et al. | |
| 6,365,429 | B1 | 4/2002 | Kneissl et al. | |
| 6,410,942 | B1 | 6/2002 | Thibeault et al. | |
| 6,420,199 | B1 | 7/2002 | Coman et al. | |
| 6,420,242 | B1 | 7/2002 | Cheung et al. | |
| 6,429,460 | B1 | 8/2002 | Chen et al. | |
| 6,448,102 | B1 | 9/2002 | Kneissl et al. | |
| 6,465,809 | B1 | 10/2002 | Furukawa et al. | |
| 6,468,824 | B2 | 10/2002 | Chen et al. | |
| 6,559,075 | B1 | 5/2003 | Kelly et al. | |
| 6,562,648 | B1 | 5/2003 | Wong et al. | |
| 6,607,931 | B2 | 8/2003 | Streubel | |
| 6,657,236 | B1 | 12/2003 | Thibeault et al. | |
| 6,677,173 | B2 | 1/2004 | Ota | |
| 6,716,654 | B2 | 4/2004 | Hsu et al. | |
| 6,740,604 | B2 | 5/2004 | Kelly et al. | |
| 6,757,314 | B2 | 6/2004 | Kneissl et al. | |
| 6,786,390 | B2 | 9/2004 | Yang et al. | |
| 6,800,500 | B2 | 10/2004 | Coman et al. | |
| 6,806,112 | B1 | 10/2004 | Horng et al. | |
| 6,809,341 | B2 | 10/2004 | Hsu et al. | |
| 6,846,686 | B2 | 1/2005 | Saeki et al. | |
| 6,849,878 | B2 | 2/2005 | Bader et al. | |
| 6,884,647 | B2 | 4/2005 | Sakai et al. | |
| 6,932,497 | B1 | 8/2005 | Huang | |
| 6,949,401 | B2 | 9/2005 | Kaminski et al. | |
| 6,955,449 | B2 * | 10/2005 | Martineau | 362/246 |
| 6,972,438 | B2 | 12/2005 | Li et al. | |
| 7,061,454 | B2 | 6/2006 | Sasuga et al. | |
| 7,084,435 | B2 | 8/2006 | Sugimoto et al. | |
| 7,144,121 | B2 | 12/2006 | Minano et al. | |
| 7,281,819 | B2 * | 10/2007 | Hsieh et al. | 362/244 |
| 7,365,485 | B2 | 4/2008 | Fukasawa et al. | |
| 7,553,044 | B2 * | 6/2009 | Wedell | 362/247 |
| 2002/0139990 | A1 | 10/2002 | Suehiro et al. | |
| 2002/0149943 | A1 * | 10/2002 | Obata | 362/339 |
| 2002/0153835 | A1 | 10/2002 | Fujiwara et al. | |
| 2002/0163302 | A1 | 11/2002 | Nitta et al. | |
| 2003/0173602 | A1 | 9/2003 | Hsu et al. | |
| 2004/0070004 | A1 | 4/2004 | Eliashevich et al. | |
| 2004/0072382 | A1 | 4/2004 | Kelly et al. | |
| 2004/0094774 | A1 | 5/2004 | Steigerwald et al. | |
| 2004/0188697 | A1 | 9/2004 | Brunner et al. | |
| 2004/0207313 | A1 | 10/2004 | Omoto et al. | |
| 2005/0077535 | A1 | 4/2005 | Li | |
| 2005/0082562 | A1 | 4/2005 | Ou et al. | |
| 2005/0117320 | A1 | 6/2005 | Leu et al. | |
| 2005/0152127 | A1 | 7/2005 | Kamiya et al. | |
| 2005/0227379 | A1 | 10/2005 | Donofrio | |
| 2006/0039160 | A1 * | 2/2006 | Cassarly et al. | 362/551 |
| 2006/0139943 | A1 * | 6/2006 | Lee et al. | 362/561 |
| 2006/0220046 | A1 | 10/2006 | Yu et al. | |
| 2007/0090383 | A1 | 4/2007 | Ota et al. | |
| 2008/0036364 | A1 | 2/2008 | Li et al. | |
| 2008/0074032 | A1 | 3/2008 | Yano et al. | |

FOREIGN PATENT DOCUMENTS

| | | |
|---|---|---|
| EP | 0 936 682 | 8/1999 |
| EP | 1 059 667 | 12/2000 |
| EP | 1 156 020 | 11/2001 |
| EP | 1 198 016 | 4/2002 |
| EP | 1 246 266 | 10/2002 |
| EP | 1 263 058 | 12/2002 |
| EP | 1 345 275 | 9/2003 |
| EP | 1 653 255 | 5/2006 |
| FR | 2 586 844 | 3/1987 |
| JP | 61-059886 | 3/1986 |
| JP | 07-007179 | 10/1995 |
| JP | 11-238913 | 8/1999 |
| WO | 98/56043 | 12/1998 |
| WO | 03/005458 | 1/2003 |
| WO | 03/010832 | 2/2003 |
| WO | 2005/104247 | 11/2005 |
| WO | 2007/061758 | 5/2007 |

OTHER PUBLICATIONS

U.S. Appl. No. 11/614,180, filed Dec. 21, 2006.
U.S. Appl. No. 11/624,811, filed Jan. 19, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/755,153, filed May 30, 2007.
U.S. Appl. No. 11/856,421, filed Sep. 17, 2007.
U.S. Appl. No. 11/859,048, filed Sep. 21, 2007.
U.S. Appl. No. 11/939,047, filed Nov. 13, 2007.
U.S. Appl. No. 11/936,163, filed Nov. 7, 2007.
U.S. Appl. No. 11/843,243, filed Aug. 22, 2007.
U.S. Appl. No. 11/939,052, filed Nov. 13, 2007.
U.S. Appl. No. 11/736,799, filed Apr. 18, 2007.
U.S. Appl. No. 11/877,038, filed Oct. 23, 2007.
U.S. Appl. No. 11/870,679, filed Oct. 11, 2007.
U.S. Appl. No. 11/948,041, filed Nov. 30, 2007.
U.S. Appl. No. 11/949,222, filed Dec. 3, 2007.
U.S. Appl. No. 12/174,053, filed Jul. 16, 2008.
U.S. Appl. No. 12/002,429, filed Dec. 4, 2007.
U.S. Appl. No. 12/045,729, filed Mar. 11, 2008.
U.S. Appl. No. 11/818,818, filed Jun. 14, 2007.
U.S. Appl. No. 11/939,059, filed Nov. 13, 2007.
American Handbook of Physics Handbook, 3rd Edition, McGraw-Hain, Ed: Dwight E. Gray, 1972.
Kasugai et al., *Moth-Eye Light-Emitting Diodes*, Mater Res. Soc. Symp. Proc. vol. 831, 2005, Material Research Society, pp. E1.9.1-E1.9.6.
Kelner, G., et al., *Plasma Etching of BETA-SiC*, Journal of the Electrochemical Society, Manchester, New Hampshire, U.S. vol. 134, No. 1, Jan. 1987, pp. 253-254.
Khan, F.A., et al., *High Rate Etching of SiC Using Inductively Coupled Plasma Reactive Ion Etching in SF6-Based Gas Mixtures*, Applied Physics Letters, AIP, American Institute of Physics, Melville, NY, US, vol. 75, No. 15, Oct. 11, 1999, pp. 2268-2270.
Lagoubi et al., *Conditioning of N-Silicon by Photoelectrochimical Etching for Photovoltaic Application*, Proc. of the 11th E.C. Photovoltaic Solar Energy Conference, Oct. 12, 1992-Oct. 16, 1992, pp. 250-253, XP008043956, pp. 252-253, Fig. 8.
Lin et al., *Design and Fabrication of Omnidirectional Reflectors in the Visible Range*, Journal of Modern Otpics, vol. 52, No. 8, May 2005, pp. 1155-1160.
Mimura et al., *Blue Electroluminescence from Pourous Silicon Carbide*, Appl. Phys. Lett 65(26), Dec. 26, 1994, pp. 3350-3352.
Nichia, White LED, Part Nos. NSPW300BS, "Specifications for Nichia White LED, Model NSPW300BS," Nichia Corporation, Jan. 12, 2004.
Nichia, White LED, Part Nos. NSPW312BS, "Specifications for Nichia White LED, Model NSPW312BS," Nichia Corporation, Jan. 14, 2004.
Palmour, J.W., et al., *Crystallographic Etching Phenomenon during Plasma Etching of SiC (100) Thin Films in SF6*, Journal of the Electrochemical Society, Electrochemical Society, Manchester, N Hampshire, U.S., vol. 136, No. 2, Feb. 1, 1989, pp. 491-495.
Perduijn et al., *Light Output Feedback Solution for RGB LED Backlight Applications*, SID Digest (2000).
Perrin et al., *Left-Handed Electromagnetism obtained via Nanostructured Metamaterials: Comparison with that from Microstructured Photonic Cyrstals*,Journal of Opics A: Pure and Applied Optics 7 (2005), S3-S11.
Schnitzer, et al., *30% External Quantum Efficieny from Surface Textured, Thin-Film Light-Emitting Diodes*, Applied Physics Lett. 63(16), Oct. 18, 1993, pp. 2174-2176.
Shor, et al., *Direct Observation of Porous SiC formed by Anodization in HF*, Appl. Phys. Lett. 62(22), May 31, 1993, pp. 2836-2838.

Streubel et al., *High Brightness AlGaInP Light-Emitting Diodes*, IEEE Journal on Selected Topis in Quantum Electronics, Vo. 8, Now. 2, Mar./Apr. 2002, pp. 321-332.

Windisch et al., *Non-Resonant Cavity Light-Emitting Diodes, In Light Emitting Diodes: Research Manufacturing, and Applications* 1V, H. Walter Yao et al., Proceding of SPIE vol. 3938 (2000), pp. 70-76.

Windisch, R., et al., "40% Efficient Thin-Film Surface-Textured Light-Emitting Diodes by Optimization of Natural Lithography," IEEE Transactions on Electron Devices, ISSN: 0018-9383, vol. 47 No. 7, Jul. 2000, pp. 1492-1498.

Windisch, R., et al., Impact of Texture-Enhanced Transmission of High-Efficiency Surface-Textured Light-Emitting Diodes, *Applied Physics Letters*, vol. 79, No. 15, Oct. 8, 2001, pp. 2315-2317.

Windisch, R., et al., *Light Extraction Mechanisms in High-Efficiency Surface-Textured Light-Emitting Diodes*, IEEE Journal on Selected Topics in Quantum Electronics, vol. 8, No. 2, Mar./Apr. 2002, pp. 248-255.

Zangooie et al., *Surface, Pore Morphology, and Optical Properties of Porous 4H-SiC*, Journal of the Electrochemical Society, 148(6) G297-G302 (2001), Jan. 9, 2001.

Zhu et al., *Optimizing the Performance of Remote Phosphor LED*, First International Conference on White LED's and Solid State Lighting, PW-48 (Nov. 26-30, 2007).

Kim, J. K. et al., "Strongly Enhanced Phosphor Efficiency in GaInN White Light-Emitting Diodes Using Remote Phosphor Configuration and Diffuse Reflector Cup," Japanese Journal of Applied Physics, Japan Socient of applied Physics, Tokyo, JP, vol. 44, No. 20-23, XP-001236966, Jan. 1, 2005.

Sakai et al., *Experimental Investigation of Dependence of Electrical Characteristics on Device Parameters in Trench Mos BarrierShotticy Diodes*, Proceedings of 1998 International Symposium on Power Semiconductor Devices & ICs, Kyoto, pp. 293-296, Jun. 1998.

Zhang AP et al., *Comparison of GAN P-I-N and Schottky Rectifier Performance*, IEEE Transactions on Electron Devices, IEEE Inc., New York, US, Vo. 48, No. 3, pp. 407-411, Mar. 2001.

Morris et al., "Engineered diffusers™ for display and illumination systems: Design, fabrication, and applications", Abstract, www.RPCphotonics.com, pp. 1-11.

Sales et al., "Engineered microlens arrays provide new control for display and lighting applications.", Light Tamers, Reprinted from the Jun. 2004 issue of Photonics Spectra, pp. 1-4.

Led Light Shapers, www.rpcphotonics.com/shapers.asp, pp. 1-3.

* cited by examiner

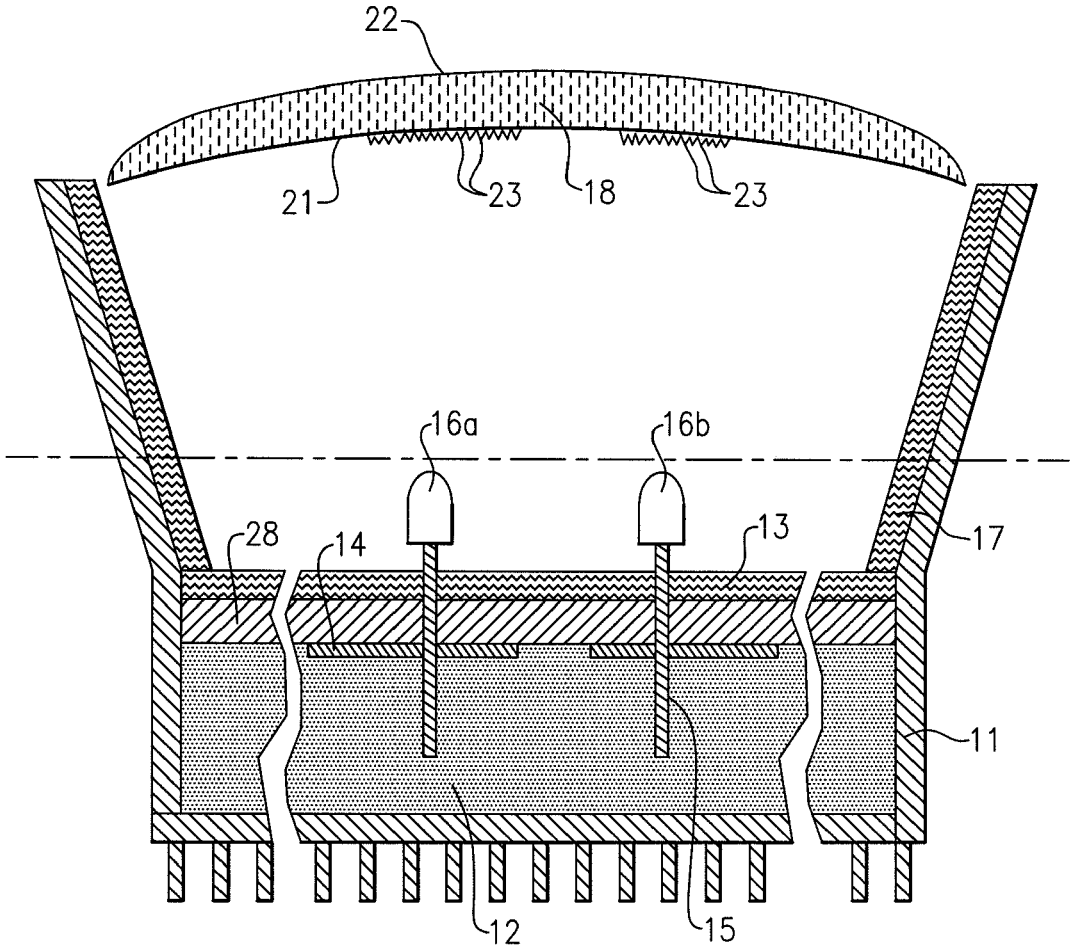
22
21
23
18
23
16a
16b
28
14
13
17
11
12
15

LIGHTING DEVICE AND LIGHTING METHOD

CROSS-REFERENCE TO RELATED APPLICATIONS

This application claims the benefit of U.S. Provisional Patent Application No. 60/868,443, filed Dec. 4, 2006, the entirety of which is incorporated herein by reference.

FIELD OF THE INVENTION(S)

The present inventive subject matter relates to a lighting device, in particular to a lighting device which comprises at least one solid state lighting device.

BACKGROUND OF THE INVENTION(S)

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes have typical lifetimes between 50,000 and 70,000 hours. Fluorescent bulbs have longer lifetimes (e.g., 10,000-20,000 hours) than incandescent lights, but provide less favorable color reproduction.

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (1 m/W), and/or duration of service.

A variety of solid state light emitters are well-known. For example, one type of solid state light emitter is a light emitting diode.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present inventive subject matter can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI Ra).

BRIEF SUMMARY OF THE INVENTION(S)

According to a first aspect of the present inventive subject matter, there is provided a lighting device which comprises at least a first solid state lighting device and at least a first patterned diffuser, in which the first solid state lighting device is positioned relative to the first patterned diffuser such that if the first solid state lighting device is illuminated so that the first solid state lighting device emits light, at least some of the light emitted by the first solid state lighting device enters the first patterned diffuser and exits the patterned diffuser, the patterned diffuser comprising a plurality of optical features.

According to a second aspect of the present inventive subject matter, there is provided a method of lighting which comprises illuminating at least a first solid state lighting device so that the first solid state lighting device emits light, such that at least some of the light emitted by the first solid state lighting device enters a first patterned diffuser and exits the patterned diffuser.

According to a third aspect of the present inventive subject matter, there is provided a lighting device which comprises at least a first solid state lighting device and at least a first optical element, the first solid state lighting device being positioned relative to the first optical element such that if the first solid state lighting device is illuminated so that the first solid state lighting device emits light, at least some of the light emitted by the first solid state lighting device enters the first optical element through a first surface of the first optical element and exits the optical element through a second surface of the first optical element, the optical element comprising a plurality of optical features, at least some of the optical features being positioned on the first surface of the first optical element.

Persons of skill in the art are familiar with, and have ready access to, a wide variety of patterned diffusers. Such patterned diffusers are also sometimes referred to as "engineered diffusers." Any desired patterned diffuser can be employed in the lighting devices and methods of the present inventive subject matter. Such patterned diffusers include optical features, such that a substantial portion, e.g., at least 50%, at least 60%, at least 70%, in some cases at least 80% or at least 90%, and in some cases at least 95% or 99%, of the light which enters the patterned diffuser exits the patterned diffuser within a pattern such that a projected pattern (e.g., a square, a rectangle, a hexagon, an octagon, etc.) of the emitted light would be produced (regardless of the pattern of the light which enters the patterned diffuser) on a structure having a flat surface positioned in the path of the emitted light and substantially perpendicular to the path of at least a portion (e.g., at least 50%, or 75%, or 90%) of the emitted light.

Representative examples of such commercially available patterned diffusers include those marketed by RPC Photonics.

In some embodiments of the present inventive subject matter, the light emitted by the first solid state lighting device enters the first patterned diffuser through a first surface of the first patterned diffuser and exits the first patterned diffuser through a second surface of the first patterned diffuser. In some such embodiments, at least some of the optical features are positioned on the first surface of the first patterned diffuser.

In some embodiments according to the present inventive subject matter, the patterned diffuser emits light in a substantially square shape.

In some embodiments according to the present inventive subject matter, the patterned diffuser emits light in a substantially rectangular shape.

In some embodiments according to the present inventive subject matter, the patterned diffuser emits light in a substantially hexagonal shape.

In some embodiments according to the present inventive subject matter, the lighting device comprises a plurality of solid state lighting devices and a plurality of patterned diffusers. In some such embodiments, (1) the plurality of patterned diffusers comprises a plurality of patterned diffusers which emit light in a substantially hexagonal shape, or (2) the plurality of patterned diffusers comprises a plurality of patterned diffusers which emit light in a substantially octagonal shape and a plurality of patterned diffusers which emit light in a substantially square shape.

In some embodiments according to the present inventive subject matter, the lighting device comprises a plurality of patterned diffusers having at least two different patterns, such that the pattern of light emitted from the lighting device can readily be changed.

In some embodiments according to the second aspect of the present inventive subject matter, at least one patterned diffuser is changed so that at least one pattern of emitted light is changed to a different pattern.

The inventive subject matter may be more fully understood with reference to the accompanying drawing and the following detailed description of the inventive subject matter.

BRIEF DESCRIPTION OF THE DRAWING FIGURE

FIG. 1 is a sectional view of a first embodiment of a lighting device according to the present inventive subject matter.

DETAILED DESCRIPTION OF THE INVENTION(S)

The present inventive subject matter now will be described more fully hereinafter with reference to the accompanying drawings, in which embodiments of the inventive subject matter are shown. However, this inventive subject matter should not be construed as limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Furthermore, relative terms, such as "lower" or "bottom" and "upper" or "top," may be used herein to describe one element's relationship to another elements as illustrated in the FIGURE. Such relative terms are intended to encompass different orientations of the device in addition to the orientation depicted in the FIGURE. For example, if the device in the FIGURE is turned over, elements described as being on the "lower" side of other elements would then be oriented on "upper" sides of the other elements. The exemplary term "lower", can therefore, encompass both an orientation of "lower" and "upper," depending on the particular orientation of the FIGURE. Similarly, if the device in the FIGURE is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a solid state light emitter, means that at least some current is being supplied to the solid state light emitter to cause the solid state light emitter to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

As used herein, the term "substantially," e.g., in the expressions "substantially perpendicular", "substantially square", "substantially rectangular", "substantially hexagonal", "substantially octagonal", etc., means at least about 90% correspondence with the feature recited, e.g., the expression "substantially perpendicular", as used herein, means that at least 90% of the points in the structure which is characterized as being substantially perpendicular to a reference plane or line are located on one of or between a pair of planes (1) which are perpendicular to the reference plane, (2) which are parallel to each other and (3) which are spaced from each other by a distance of not more than 10% of the largest dimension of the structure;

the expression "substantially square" means that a square shape can be identified, wherein at least 90% of the points in the item which is characterized as being substantially square fall within the square shape, and the square shape includes at least 90% of the point in the item;

the expression "substantially rectangular" means that a rectangular shape can be identified, wherein at least 90% of the points in the item which is characterized as being substantially rectangular fall within the rectangular shape, and the rectangular shape includes at least 90% of the point in the item;

the expression "substantially hexagonal" means that a hexagonal shape can be identified, wherein at least 90% of the points in the item which is characterized as being substantially hexagonal fall within the hexagonal shape, and the hexagonal shape includes at least 90% of the point in the item;

the expression "substantially octagonal" means that an octagonal shape can be identified, wherein at least 90% of the points in the item which is characterized as being substantially octagonal fall within the octagonal shape, and the octagonal shape includes at least 90% of the point in the item;

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, according to the first aspect of the present inventive subject matter, there are provided lighting devices comprising at least a first solid state lighting device and at least a first patterned diffuser.

Any desired solid state light emitter or emitters can be employed in accordance with the present inventive subject matter. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

Where more than one solid state light emitter is employed, the respective light emitters can be similar to one another, different from one another or any combination (i.e., there can be a plurality of solid state light emitters of one type, or one or more solid state light emitters of each of two or more types)

As indicated above, the lighting devices according to the present inventive subject matter can comprise any desired number of solid state emitters. For example, a lighting device according to the present inventive subject matter can include one or more light emitting diodes, 50 or more light emitting diodes, or 100 or more light emitting diodes, etc.

In some embodiments according to the present inventive subject matter, the lighting device further comprises at least one lumiphor (i.e., luminescence region or luminescent element which comprises at least one luminescent material which, when excited, emits light). The expression "lumiphor", as used herein, refers to any luminescent element, i.e., any element which includes a luminescent material.

The one or more lumiphors, when provided, can individually be any lumiphor, a wide variety of which are known to those skilled in the art. For example, the one or more luminescent materials in the lumiphor can be selected from among phosphors, scintillators, day glow tapes, inks which glow in the visible spectrum upon illumination with ultraviolet light, etc. The one or more luminescent materials can be down-converting or up-converting, or can include a combination of both types. For example, the first lumiphor can comprise one or more down-converting luminescent materials.

The (or each of the) one or more lumiphor(s) can, if desired, further comprise (or consist essentially of, or consist of) one or more highly transmissive (e.g., transparent or substantially transparent, or somewhat diffuse) binder, e.g., made of epoxy, silicone, glass, metal oxide or any other suitable material (for example, in any given lumiphor comprising one or more binder, one or more phosphor can be dispersed within the one or more binder). In general, the thicker the lumiphor, the lower the weight percentage of the phosphor can be. Representative examples of the weight percentage of phosphor include from about 3.3 weight percent up to about 20 weight percent, although, as indicated above, depending on the overall thickness of the lumiphor, the weight percentage of the phosphor could be generally any value, e.g., from 0.1 weight percent to 100 weight percent (e.g., a lumiphor formed by subjecting pure phosphor to a hot isostatic pressing procedure).

Devices in which a lumiphor is provided can, if desired, further comprise one or more clear encapsulant (comprising, e.g., one or more silicone materials) positioned between the solid state light emitter (e.g., light emitting diode) and the lumiphor.

For example, light emitting diodes and lumiphors which may be used in practicing the present inventive subject matter are described in:

(1) U.S. Patent Application No. 60/753,138, filed on Dec. 22, 2005, entitled "Lighting Device" (inventor: Gerald H. Negley) and U.S. patent application Ser. No. 11/614,180, filed Dec. 21, 2006, the entireties of which are hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven) and U.S. patent application Ser. No. 11/624,811, filed Jan. 19, 2007, the entireties of which are hereby incorporated by reference;

(3) U.S. Patent Application No. 60/808,702, filed on May 26, 2006, entitled "Lighting Device" (inventors: Gerald H. Negley and Antony Paul van de Ven) and U.S. patent application Ser. No. 11/751,982, filed May 22, 2007, the entireties of which are hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter) and U.S. patent application Ser. No. 11/753,103, filed May 24, 2007, the entireties of which are hereby incorporated by reference;

(5) U.S. Patent Application No. 60/802,697, filed on May 23, 2006, entitled "Lighting Device and Method of Making" (inventor: Gerald H. Negley) and U.S. patent application Ser. No. 11/751,990, filed May 22, 2007, the entireties of which are hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley) and U.S. patent application Ser. No. 11/843,243, filed Aug. 22, 2007, the entireties of which are hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and (8) U.S. Patent Application No. 60/851,230, filed on Oct. 12, 2006, entitled "LIGHTING DEVICE AND METHOD OF MAKING SAME" (inventor: Gerald H. Negley, the entirety of which is hereby incorporated by reference.

The lighting devices of the present inventive subject matter can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter. The lighting devices of the present inventive subject matter can be electrically connected (or selectively connected) to any desired power source, persons of skill in the art being familiar with a variety of such power sources.

Representative examples of arrangements of sources of visible light, mounting structures, schemes for mounting sources of visible light, apparatus for supplying electricity to sources of visible light, housings for sources of visible light, fixtures for sources of visible light, power supplies for sources of visible light and complete lighting assemblies, all of which are suitable for the lighting devices of the present inventive subject matter, are described in:

(1) U.S. Patent Application No. 60/752,753, filed on Dec. 21, 2005, entitled "Lighting Device" (inventors: Gerald H. Negley, Antony Paul van de Ven and Neal Hunter) and U.S. patent application Ser. No. 11/613,692, filed Dec. 20, 2006, the entireties of which are hereby incorporated by reference;

(2) U.S. Patent Application No. 60/798,446, filed on May 5, 2006, entitled "Lighting Device" (inventor: Antony Paul van de Ven) and U.S. patent application Ser. No. 11/743,754, filed May 3, 2007, the entireties of which are hereby incorporated by reference;

(3) U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), and U.S. patent application Ser. No. 11/856,421, filed Sep. 17, 2007, the entireties of which are hereby incorporated by reference;

(4) U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), and U.S. patent application Ser. No. 11/859,048, filed Sep. 21, 2007, the entireties of which are hereby incorporated by reference;

(5) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman) and U.S. patent application Ser. No. 11/755,153, filed May 30, 2007, the entireties of which are hereby incorporated by reference;

(6) U.S. Patent Application No. 60/858,558, filed on Nov. 13, 2006, entitled "LIGHTING DEVICE, ILLUMINATED ENCLOSURE AND LIGHTING METHODS" (inventor: Gerald H. Negley), the entirety of which is hereby incorporated by reference.

(7) U.S. Patent Application No. 60/858,881, filed on Nov. 14, 2006, entitled "LIGHT ENGINE ASSEMBLIES" (inventors: Paul Kenneth Pickard and Gary David Trott), the entirety of which is hereby incorporated by reference;

(8) U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard) and U.S. patent application Ser. No. 11/736,799, filed Apr. 18, 2007, the entireties of which are hereby incorporated by reference;

(9) U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference;

(10) U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams), the entirety of which is hereby incorporated by reference; and

(11) U.S. Patent Application No. 60/916,384, filed on May 7, 2007, entitled "LIGHT FIXTURES, LIGHTING DEVICES, AND COMPONENTS FOR THE SAME" (inventors: Paul Kenneth Pickard, Gary David Trott and Ed Adams), the entirety of which is hereby incorporated by reference.

As noted above, according to a third aspect of the present inventive subject matter, there is provided a lighting device, comprising at least a first solid state lighting device; and at least a first optical element.

Persons skilled in the art are familiar with, and have ready access to, a wide variety of optical elements, any of which is suitable for use in the lighting devices according to the present inventive subject matter.

Embodiments in accordance with the present inventive subject matter are described herein with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as limited to the particular shapes of regions illustrated herein but are to include deviations in shapes that result, for example, from manufacturing. For example, a molded region illustrated or described as a rectangle will, typically, have rounded or curved features. Thus, the regions illustrated in the FIGURE are schematic in nature and their shapes are not intended to illustrate the precise shape of a region of a device and are not intended to limit the scope of the present inventive subject matter.

FIG. 1 is a sectional view of a first embodiment of a lighting device according to the present inventive subject matter.

Referring to FIG. 1, there is shown a lighting device which comprises plural solid state lighting devices 16*a* and 16*b* (LEDs in this embodiment), a patterned diffuser 18, a heat spreading element 11, insulating regions 12, a highly reflective surface 13, conductive traces 14 formed on a printed circuit board 28, a lead frame 15 and a reflective cone 17. The LEDs 16*a* and 16*b* are positioned relative to the patterned diffuser 18 such that if the LEDs 16*a* and 16*b* are illuminated so that they emit light, at least some of the light emitted by the LEDs 16*a* and 16*b* enters the patterned diffuser 18 through a first surface 21 and exits the patterned diffuser 18 through a second surface 22, the patterned diffuser 18 comprising a plurality of optical features 23 formed on the first surface 21.

Any two or more structural parts of the lighting devices described herein can be integrated. Any structural part of the lighting devices described herein can be provided in two or more parts which are held together, if necessary. Similarly, any two or more functions can be conducted simultaneously, and/or any function can be conducted in a series of steps.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the FIGURE, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

The invention claimed is:

1. A lighting device, comprising:

at least a first solid state lighting device; and at least a first patterned diffuser, said first solid state lighting device positioned relative to said first patterned diffuser such that if said first solid state lighting device is illuminated so that said first solid state lighting device emits light, at least some of said light emitted by said first solid state lighting device enters said first patterned diffuser and exits said patterned diffuser, said patterned diffuser comprising a plurality of optical features such that at least 50% of light that enters said patterned diffuser exits said patterned diffuser within an exit pattern, regardless of an entrance pattern of the light that enters said patterned diffuser.

2. A lighting device as recited in claim 1, wherein said exit pattern is a substantially square shape.

3. A lighting device as recited in claim 1, wherein said exit pattern is a substantially rectangular shape.

4. A lighting device as recited in claim 1, wherein said exit pattern is a substantially hexagonal shape.

5. A lighting device as recited in claim 1, wherein said lighting device comprises a plurality of solid state lighting devices and a plurality of patterned diffusers.

6. A lighting device as recited in claim 5, wherein said plurality of patterned diffusers comprises a plurality of patterned diffusers which emit light in a substantially hexagonal shape.

7. A lighting device as recited in claim 5, wherein said plurality of patterned diffusers comprises a plurality of patterned diffusers which emit light in a substantially octagonal shape and a plurality of patterned diffusers which emit light in a substantially square shape.

8. A lighting device as recited in claim 1, wherein said light emitted by said first solid state lighting device enters said first patterned diffuser through a first surface of said first patterned diffuser and exits said first patterned diffuser through a second surface of said first patterned diffuser.

9. A lighting device as recited in claim 8, wherein at least some of said optical features are on said first surface of said first patterned diffuser.

10. A method of lighting, comprising:

illuminating at least a first solid state lighting device so that said first solid state lighting device emits light, such that at least some of said light emitted by said first solid state lighting device enters a patterned diffuser and exits said patterned diffuser, said patterned diffuser comprising a plurality of optical features, such that at least 50% of said light emitted by said first solid state lighting device that enters said patterned diffuser exits said patterned diffuser within an exit pattern, regardless of an entrance pattern of the light that enters said patterned diffuser.

11. A method as recited in claim 10, wherein said exit pattern is a hexagonal shape.

12. A method as recited in claim 10, wherein said lighting device comprises a plurality of solid state lighting devices and a plurality of patterned diffusers.

13. A method as recited in claim 12, wherein said plurality of patterned diffusers comprises a plurality of patterned diffusers which emit light in a substantially hexagonal shape.

14. A method as recited in claim 12, wherein said plurality of patterned diffusers comprises a plurality of patterned diffusers which emit light in a substantially octagonal shape and a plurality of patterned diffusers which emit light in a substantially square shape.

15. A method as recited in claim 10, wherein said patterned diffuser emits light in a substantially square shape.

16. A method as recited in claim 10, wherein said patterned diffuser emits light in a substantially rectangular shape.

17. A lighting device, comprising:

at least a first solid state lighting device; and at least a first patterned diffuser, said first solid state lighting device positioned relative to said first patterned diffuser such that if said first solid state lighting device is illuminated so that said first solid state lighting device emits light, at least some of said light emitted by said first solid state lighting device enters said first patterned diffuser and exits said patterned diffuser, said patterned diffuser comprising a plurality of optical features such that at least 50% of light that enters said patterned diffuser exits said patterned diffuser within an exit pattern, said exit pattern the same for all possible entrance patterns of light entering said patterned diffuser.

* * * * *